US008590503B2

(12) United States Patent
Hütter et al.

(10) Patent No.: US 8,590,503 B2
(45) Date of Patent: Nov. 26, 2013

(54) INTERNAL COMBUSTION ENGINE AND CYLINDER HEAD COVER

(75) Inventors: Ulrich Hütter, Schorndorf (DE); Jan Scheffel, Stuttgart (DE); Daniel Wirbel, Weinstadt (DE); Julian Cojocaru, Sag (RO)

(73) Assignee: Mahle International GmbH (DE)

( * ) Notice: Subject to any disclaimer, the term of this patent is extended or adjusted under 35 U.S.C. 154(b) by 209 days.

(21) Appl. No.: 13/110,432

(22) Filed: May 18, 2011

(65) Prior Publication Data

US 2011/0290210 A1 Dec. 1, 2011

(30) Foreign Application Priority Data

May 19, 2010 (DE) ..... 10 2010 020 982

(51) Int. Cl.
*F02B 7/00* (2006.01)

(52) U.S. Cl.
USPC ..... 123/195 C; 123/195 R; 123/90.38

(58) Field of Classification Search
USPC ..... 123/193.5, 195 R, 195 C, 193.3, 193.2, 123/90.38, 143 C
See application file for complete search history.

(56) References Cited

U.S. PATENT DOCUMENTS

| | | | | |
|---|---|---|---|---|
| 4,305,684 | A | 12/1981 | Walbrohl | |
| 5,003,958 | A * | 4/1991 | Yoneyama et al. | 123/635 |
| 5,035,637 | A * | 7/1991 | Mathews et al. | 439/271 |
| 5,390,648 | A * | 2/1995 | Yanase | 123/634 |
| 5,746,168 | A | 5/1998 | Lochbrunner et al. | |
| 5,771,850 | A | 6/1998 | Okada | |
| 6,240,903 | B1 * | 6/2001 | Kurozumi | 123/472 |
| 6,672,272 | B2 * | 1/2004 | McGloin | 123/195 C |
| 7,341,033 | B2 * | 3/2008 | Yoshijima et al. | 123/90.38 |
| 7,594,488 | B2 * | 9/2009 | Yoshijima et al. | 123/90.38 |
| 2003/0089328 | A1 * | 5/2003 | McGloin | 123/193.5 |

FOREIGN PATENT DOCUMENTS

| | | |
|---|---|---|
| DE | 4305684 A1 | 9/1993 |
| DE | 29603254 U1 | 7/1997 |
| JP | 03260335 | 11/1991 |

OTHER PUBLICATIONS

English abstract for JP-03260335.
European Search Report for EP-11165945.

* cited by examiner

*Primary Examiner* — Noah Kamen
*Assistant Examiner* — Long T Tran
(74) *Attorney, Agent, or Firm* — Mahle International GmbH

(57) ABSTRACT

An internal combustion engine of a motor vehicle may include a cylinder head having an open cylinder head interior on a cylinder head side. A cylinder head cover may be disposed on the cylinder head for covering the cylinder head interior at the open cylinder head side. An internal wiring may be disposed in the cylinder head interior for supplying electrical energy to electrical components. The internal wiring may have at least one electrical internal interface disposed on the cylinder head in the cylinder head interior. At least one connecting bridge may have an inner connecting interface configured in a complementary manner to the internal interface, and an outer connecting interface connected electrically therewith. The external wiring may be disposed outside the cylinder head interior.

20 Claims, 3 Drawing Sheets

INTERNAL COMBUSTION ENGINE AND CYLINDER HEAD COVER

CROSS-REFERENCES TO RELATED APPLICATION

This application claims priority to German patent application DE 10 2010 020 982.1 filed on May 19, 2010, which is hereby incorporated by reference in its entirety.

TECHNICAL FIELD

The present invention relates to an internal combustion engine, in particular a motor vehicle. The invention further relates to a cylinder head cover for such an internal combustion engine.

BACKGROUND

An internal combustion engine configured as a piston engine usually has a cylinder head with a cylinder head interior which is open at a cylinder head side. To cover the cylinder head interior at the open cylinder head side, a cylinder head cover is able to be mounted on the cylinder head. In the cylinder head interior an internal wiring can be laid, by means of which electrical components of the internal combustion engine, such as e.g. the fuel injectors, ignition devices for spark-ignited engines or heating devices for self-igniting engines or electromagnetic gas-exchange valves can be supplied with electrical energy or respectively can be activated electrically.

It is now a problem to electrically connect the inner wiring through the cylinder head cover with an external wiring.

From U.S. Pat. No. 5,771,850 a cylinder head cover is known, on the outer side of which several electrical interfaces are integrally formed. In addition, electric lines can be integrated into the wall of the cylinder head cover.

From DE 43 05 684 A1 a cylinder head cover is known which has current consumption plug connectors and current supply connecting terminals on its inner side facing the cylinder head interior, such that on mounting of the cylinder head cover they are aligned to contact connecting terminals of ignition coils, so that an electrical contacting is produced automatically on mounting of the cylinder head cover.

SUMMARY

The present invention deals with the problem of indicating an improved embodiment for an internal combustion engine or respectively for an associated cylinder head cover, which is distinguished in particular by a simplified mounting. Hereby, in particular a maintenance is to be simplified in which the cylinder head cover is removed from the cylinder head.

This problem is solved according to the invention by the subject matter of the independent claims. Advantageous embodiments are the subject matter of the dependent claims.

The invention is based on the general idea of equipping the cylinder head cover with at least one connecting bridge, which has an inner connecting interface and an outer connecting interface connected electrically therewith. The inner connecting interface of the connecting bridge is configured in a complementary manner to an internal interface which is arranged fixedly on the cylinder head in the cylinder head interior, electrically connected with the internal wiring. The outer connecting interface of the connecting bridge is configured in a complementary manner to an external interface, which is arranged outside the cylinder head interior, which is arranged fixedly relative to the cylinder head and which is electrically connected with an external wiring. The use of such a connecting bridge has the result that the external wiring and the internal wiring remain largely unaffected by the mounting and dismantling of the cylinder head cover, because only the respective connecting bridge, in particular together with the cylinder head cover, is removed or respectively installed.

The arrangement and configuration of the interfaces and of the connecting interfaces can now be selected in a targeted manner in accordance with an advantageous embodiment so that the interfaces which are complementary to each other are automatically connected with each other electrically on mounting of the cylinder head cover on the cylinder head and are automatically separated from each other electrically on dismantling of the cylinder head cover from the cylinder head.

By an integration of the connecting bridge into the cylinder head cover, on the one hand it is achieved that an operation of the internal combustion engine is not possible without the cylinder head cover. This is because if the cylinder head cover is absent, the connecting bridge is also absent, so that the external wiring is not coupled electrically with the internal wiring. On the other hand, the connecting bridge can be readily integrated into the cylinder head cover, so that with a mounted cylinder head cover the inner connecting interface is arranged in the cylinder head interior, whilst the outer connecting interface is arranged outside the cylinder head interior. In particular, thereby a sealed separation can be realized between the cylinder head interior and the environment despite the electrical connection, guided through the cylinder head cover, of the internal wiring with the external wiring.

In an advantageous embodiment, the interfaces and the connecting interfaces can each form an electric plug connection, wherein the two plug connections have plug-in directions parallel to each other. The plug-in directions which are parallel to each other facilitate the mounting and dismantling of the cylinder head cover. The connecting interfaces of the connecting bridge on the cover side here can be configured as plugs, whilst the interfaces of the wirings are then configured as a socket or bush. Basically, however, a reverse construction is also possible, in which the interfaces of the wirings form the plugs and the connecting interfaces of the connecting bridge form the sockets or bushes. A mixed type of construction is also conceivable, in which one connecting interface on the cover side forms a plug, whilst the other quick-connecting interface on the cover side forms a socket or a bush. The interfaces of the wirings are then configured in a complementary manner as plug or respectively socket.

According to a particularly advantageous embodiment, a cover seal can be arranged between the cylinder head cover and the cylinder head, which extends through between the interfaces, so that the internal interface is arranged inside the cover seal, whereas the external interface is arranged outside the cover seal. Through this type of construction, a tight or hermetic encapsulation of the cylinder head interior is realized by means of the cylinder head cover for the mounted state of the cylinder head cover, although the internal wiring is electrically connected with the external wiring through the cylinder head cover, namely via the respective connecting bridge.

In a further advantageous embodiment, an inner interface seal surrounding the internal interface can be provided between the cylinder head and the cylinder head cover. In addition or alternatively, an outer interface seal surrounding the external interface can be provided between the cylinder head and the cylinder head cover. Such an interface seal can be provided here additionally to the above-mentioned cover seal, in order to seal the respective interface in itself. Hereby, an additional protection of the electrical contacts is produced, which are situated inside the respective interface.

The respect interface seal can basically represent a separate component with respect to the cover seal. However, an embodiment is particularly advantageous in which at least one of these interface seals is formed integrally on the cover seal. The mounting is simplified hereby, because only one component, namely the cover seal, has to be mounted with the respective integrated interface seal on the cylinder head cover or respectively on the cylinder head.

According to another embodiment, the connecting bridge can be a separate component with respect to the cylinder head cover, which is attached onto the cylinder head cover. The connecting bridge can be applied fixedly or detachably here on the cylinder head cover. However, an alternative embodiment is preferred, in which the connecting bridge is formed integrally on the cylinder head cover.

Generally, the connecting bridge can have a body into which an electrical contacting comprising several electrical contacts is embedded, which connects the connecting interfaces with each other electrically. This body of the connecting bridge can now be attached to the cylinder head cover, fixedly or detachably, or can be formed by an integral component of the cylinder head cover. For example, the electrical contacting on injection moulding of the body of the connecting bridge or of the cylinder head cover from plastic in the injection moulding tool can be positioned so that the desired embedding is produced for the contacting.

The present invention concerns not only the internal combustion engine equipped with such a cylinder head cover and the associated especially arranged internal and external wiring, but also a cylinder head cover with at least one connecting bridge of the type described above, which is suitable for use with such an internal combustion engine.

The cylinder head cover can optionally have an inner through-opening, through which the internal interface is electrically connectable with the inner connecting interface. In addition or alternatively, the cylinder head cover can have an outer through-opening, through which the external interface is electrically contactable with the outer connecting interface.

Further important features and advantages of the invention will emerge from the subclaims, from the drawings and from the associated description of the figures with the aid of the drawings.

It is evident that the above-mentioned features and the features which are to be further explained below are able to be used not only in the respectively indicated combination, but also in other combinations or alone, without departing from the scope of the present invention.

Preferred example embodiments of the invention are illustrated in the drawings and are explained in further detail in the following description, wherein identical reference numbers refer to identical or similar or functionally identical components.

BRIEF DESCRIPTION OF THE DRAWING

There are shown, diagrammatically in each case.

DETAILED DESCRIPTION

Figure 1:
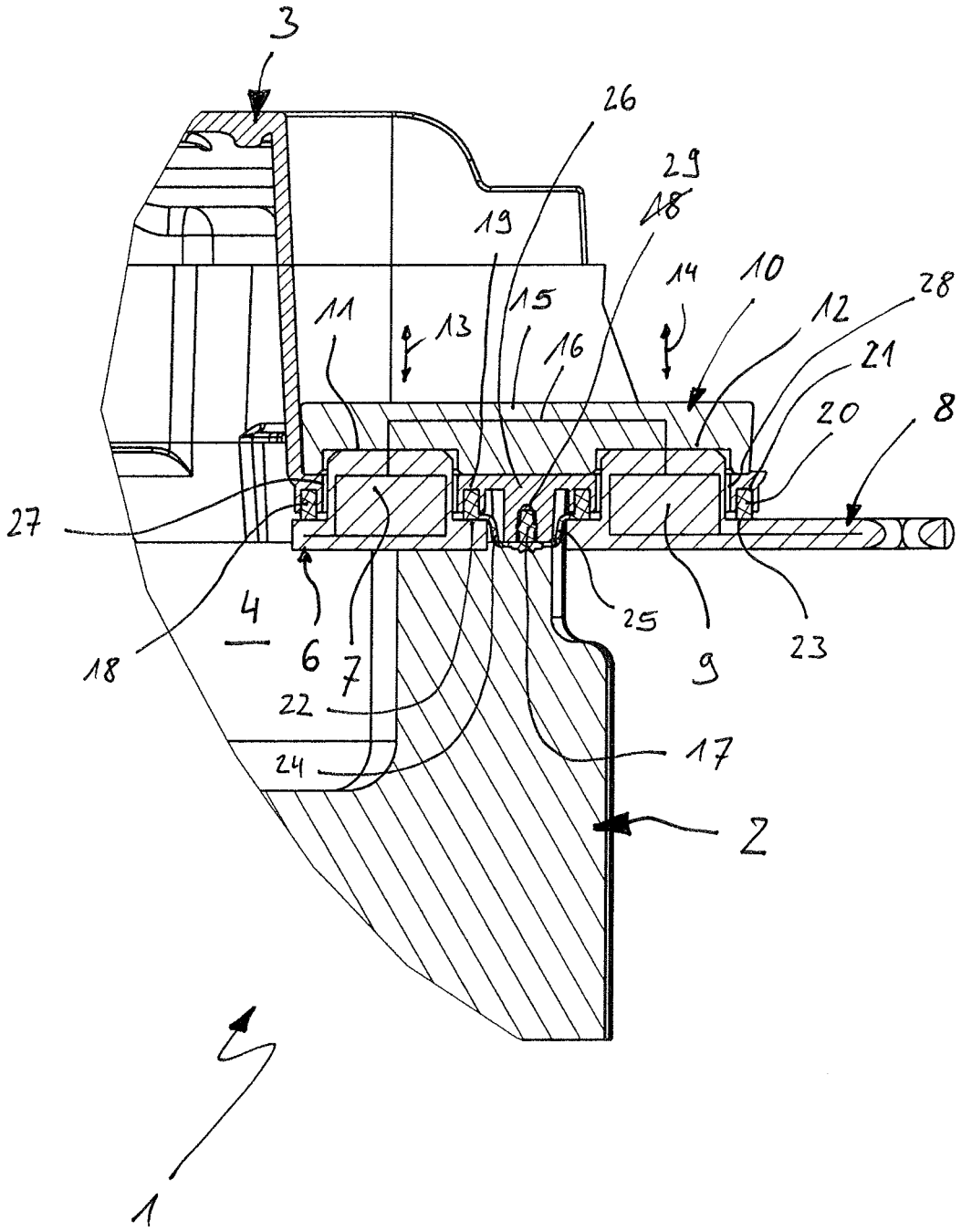
FIG. 1 a sectional view of an internal combustion engine with cylinder head cover in the region of a connecting bridge, FIG. 2 an isometric exploded illustration of the internal combustion engine in the region of a cylinder head, FIG. 3 an isometric view of the cylinder head with the cylinder head cover absent and with applied connecting bridge, FIG. 4 an isometric view of the cylinder head with mounted cylinder head cover and applied connecting bridge.

In accordance with FIGS. 1 to 4, an internal combustion engine 1, which is preferably configured as a piston engine and which can be arranged in particular in a motor vehicle, comprises a cylinder head 2 and a cylinder head cover 3. The cylinder head 2 has a cylinder head interior 4 which is open at a cylinder head side. The open cylinder head side is usually situated at the top. The cylinder head interior 4 is closed or respectively covered by means of the cylinder head cover 3 at the open cylinder head side. For this, the cylinder head cover 3 is mounted on the cylinder head 2. Several screws 5 can be used for fastening the cylinder head cover 3 on the cylinder head 2.

An internal wiring 6 is laid in the cylinder head interior 4, by means of which electrical components, which are not illustrated here, can be supplied with electrical energy and/or can be activated electrically. Such components are, for example, fuel injectors and ignition devices or heating devices. Likewise, modern internal combustion engines 1 are known, which have electromagnetically activated gas-exchange valves. This internal wiring 6 has at least one electrical internal interface 7, e.g. in the form of a multipolar plug or in the form of a multipolar socket or bush. This internal interface 7 is likewise arranged here in the cylinder head interior 4 fixedly on the cylinder head 2. For this, the internal interface 7 can be connected detachably or non-detachably with the cylinder head 2, in particular glued, gripped or screwed.

In addition, an external wiring 8 is provided, which is connected to an electrical network of the internal combustion engine 1 or respectively forms such an electrical network of the internal combustion engine 1. In a motor vehicle, the external wiring 8 is, for example, a branch of an electrical on-board supply system. The external wiring 8 has at least one electrical external interface 9, e.g. in the form of a multipolar plug or in the form of a multipolar socket or bush. This external interface 9 is arranged fixedly here relative to the cylinder head 2. The external interface 9 can likewise be connected here detachably or non-detachably with the cylinder head 2, in particular glued, gripped or screwed. In addition, it is arranged outside the cylinder head interior 4.

The cylinder head cover 3 is now equipped with at least one connecting bridge 10, which has an internal connecting interface 11 and an external connecting interface 12 and connects electrically with each other. The internal connecting interface 11 is configured in a complementary manner to the internal interface 7, e.g. as a multipolar socket or bush or as a multipolar plug. The outer connecting interface 12 is configured in a complementary manner to the external interface 9, e.g. as a multipolar socket or bush or as a multipolar plug.

Expediently, the interfaces 7, 9 with the associated connecting interfaces 11, 12 respectively form an electrical plug connection, the plug-in directions of which are indicated in FIG. 1 respectively by a double arrow 13 or respectively 14. Expediently, these plug-in directions 13, 14 of the two plug connections 7-11 or respectively 9-12 run parallel to each other.

The connecting bridge 10 has a body 15, into which an electrical contacting 16 is embedded, which consists in particular of several electric lines or leads. By means of this contacting 16, the connecting interfaces 11 and 12 of the connecting bridge 10 are electrically connected with each other, so that with a mounted connecting bridge 10 the internal wiring 6 is connected to the external wiring 8 via the interfaces 7, 9, 11, 12 cooperating with each other.

The connecting bridge 10 can be a separate component with respect to the cylinder head cover 3. The connecting bridge 10 can then be mounted after the mounting of the cylinder head cover 3. It can also be fastened fixedly or detachably on the cylinder head cover 3, so that with the mounting of the cylinder head cover 3 at the same time the connecting bridge 10 is also mounted. However, an integral forming of the connecting bridge 10 on the cylinder head cover 3 is particularly advantageous. The body 15 of the connecting bridge 10 is then an integral component of the cylinder head cover 3. For example, the cylinder head cover 3 is injection-moulded with the connecting bridge 10 from one piece in a shared injection moulding tool. The electrical contacting 16 forms an insert here into the respective injection mould, which is injected around on the injection moulding by the plastic of the cylinder head cover 3.

Therefore, an embodiment is preferred in which the interfaces 7, 9 and the connecting interfaces 11, 12 and the connecting bridge 10 are configured and arranged and coordinated with each other so that on mounting of the cylinder head cover 3 on the cylinder head 2, the interfaces 7, 9 are automatically electrically connected together with the connecting interfaces 11, 12, whilst these electrical connections between the interfaces 7, 9, 11, 12 are automatically separated electrically on dismantling of the cylinder head cover 3.

A cover seal 17 is expediently arranged between the cylinder head cover 3 and the cylinder head 2. This forms a separate component with respect to the cylinder head 2 and cylinder head cover 3 and is inserted for example into a corresponding mounting groove 18, which is constructed for this purpose on the cylinder head cover 3. The cover seal 17 extends through between the interfaces 7, 9, such that the internal interface 7 is arranged inside the cover seal 17, i.e. on a side facing the cylinder head interior 4, whereas the external interface 9 is arranged outside the cover seal 17, i.e. on a side facing away from the cylinder head interior 4.

In the example which is shown, in addition an inner interface seal 18 is provided, which surrounds the internal interface 7 and in so doing is likewise arranged between cylinder head 2 and cylinder head cover 3. In the example, the cylinder head cover 3 has a suitable mounting groove 19, into which the inner interface seal 18 is inserted. In addition, in the example which is shown an outer interface seal 20 is also provided, which surrounds the external interface 9 and which is inserted here into a further mounting groove 21 which is constructed on the cylinder head cover 3. The interface seals 18, 20 rest axially for example against an annular collar 22 or respectively 23, which surrounds the internal interface 7 or respectively the external interface 9. The cover seal 17 and the interface seals 18, 20 are configured as axially-acting seals. The interface seals 18, 20 are expediently constructed in an annular shape.

The embodiment which is shown here is particularly advantageous, in which the two interface seals 18, 19 are formed integrally on the cover seal 17. In the region of the connecting bridge 10 in FIG. 1 respectively a connecting web 24 or respectively 25 can be seen, which connects the cover seal 17 with the respective interface seal 18, 20.

It is also important for the embodiment in which the connecting bridge 10 forms a separate component with respect to the cylinder head cover 3, irrespective of whether the separate connecting bridge 10 is fixedly or detachably applied on the cylinder head cover 3, that the cylinder head cover 3 has a web 26 in the region of the connecting bridge 10, which extends through between the internal interface 7 and the external interface 9 and which receives the cover seal 17 in this region. In the absence of a connecting bridge 10, therefore a completely closed cylinder head interior 4 is produced with a mounted cylinder head cover 3, apart from an inner through-opening 27, through which the plug connection is realized between internal interface 7 and inner connecting interface 11. This inner through-opening 27 is, however, sealed toward the exterior by the inner interface seal 18. In addition, the cylinder head cover 3 has an outer through-opening 28, through which the plug connection is realized between external interface 9 and outer connecting interface 12. Here, also, an effective sealing takes place by means of the outer interface seal 20.

Figure 2:
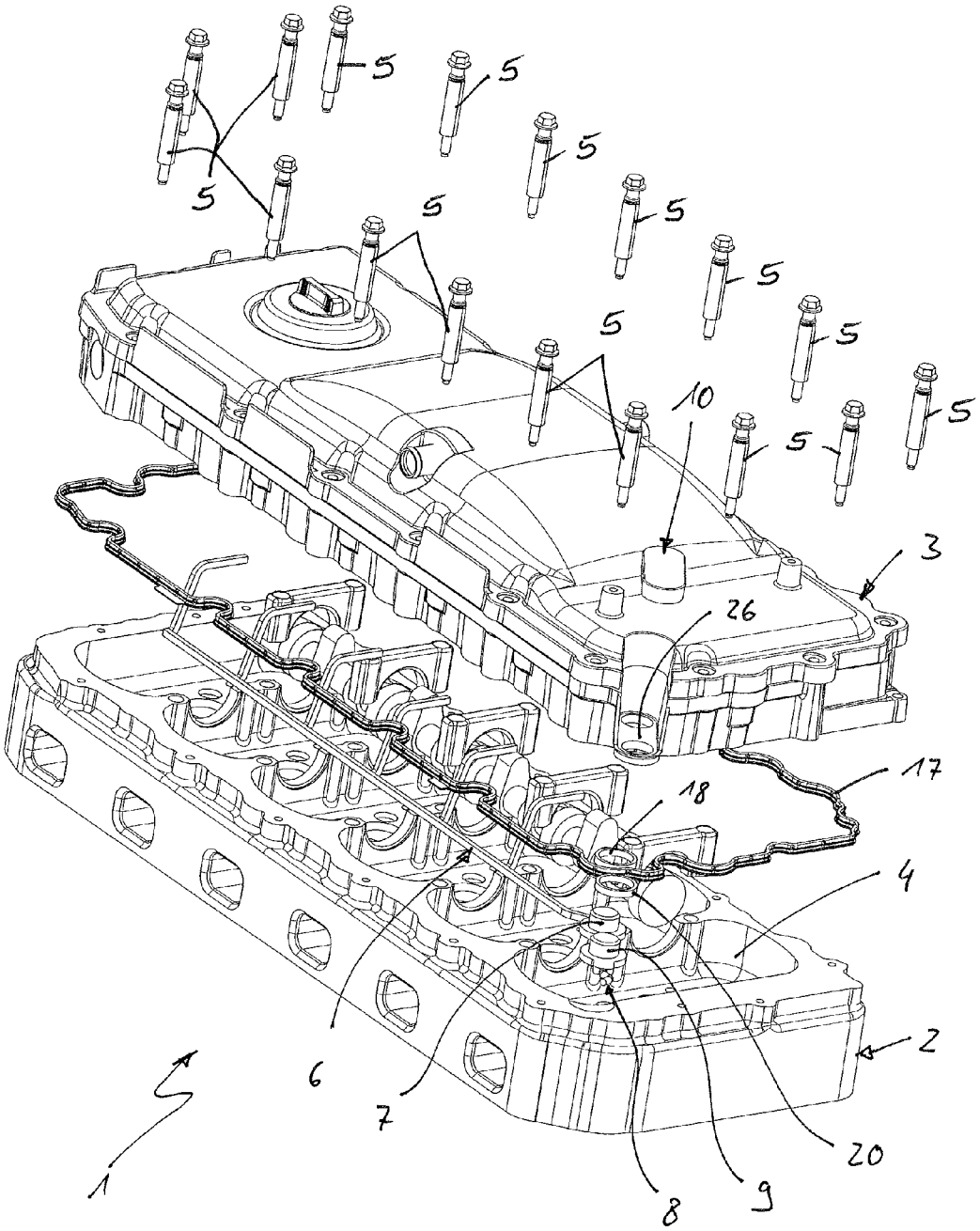
Figure 3:
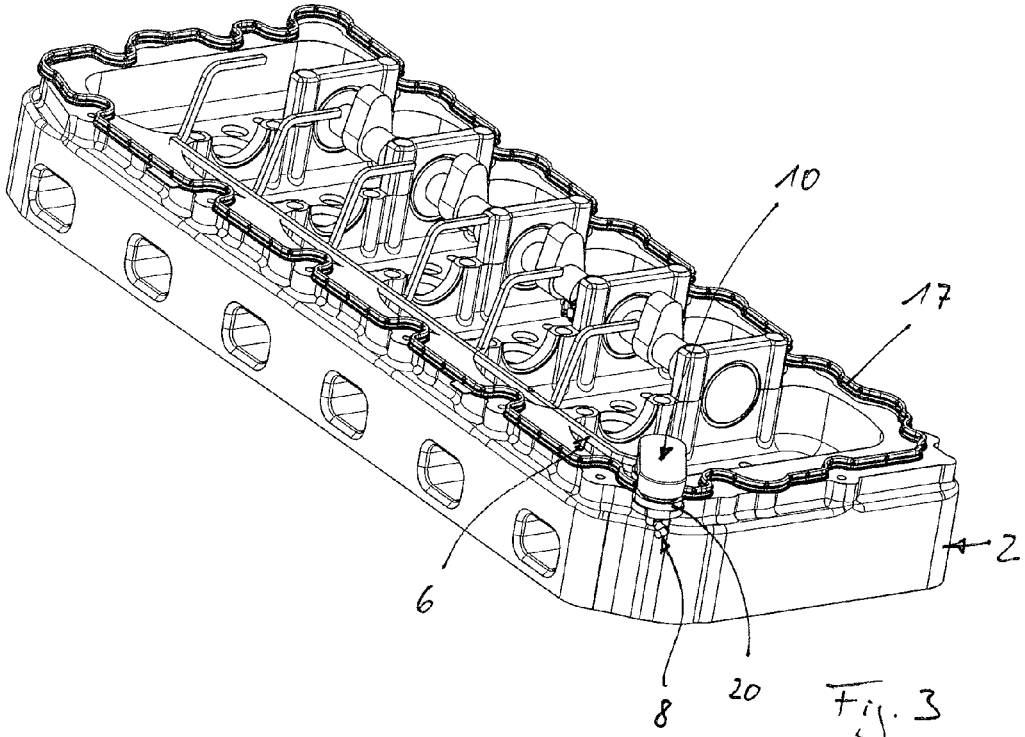
Figure 4:
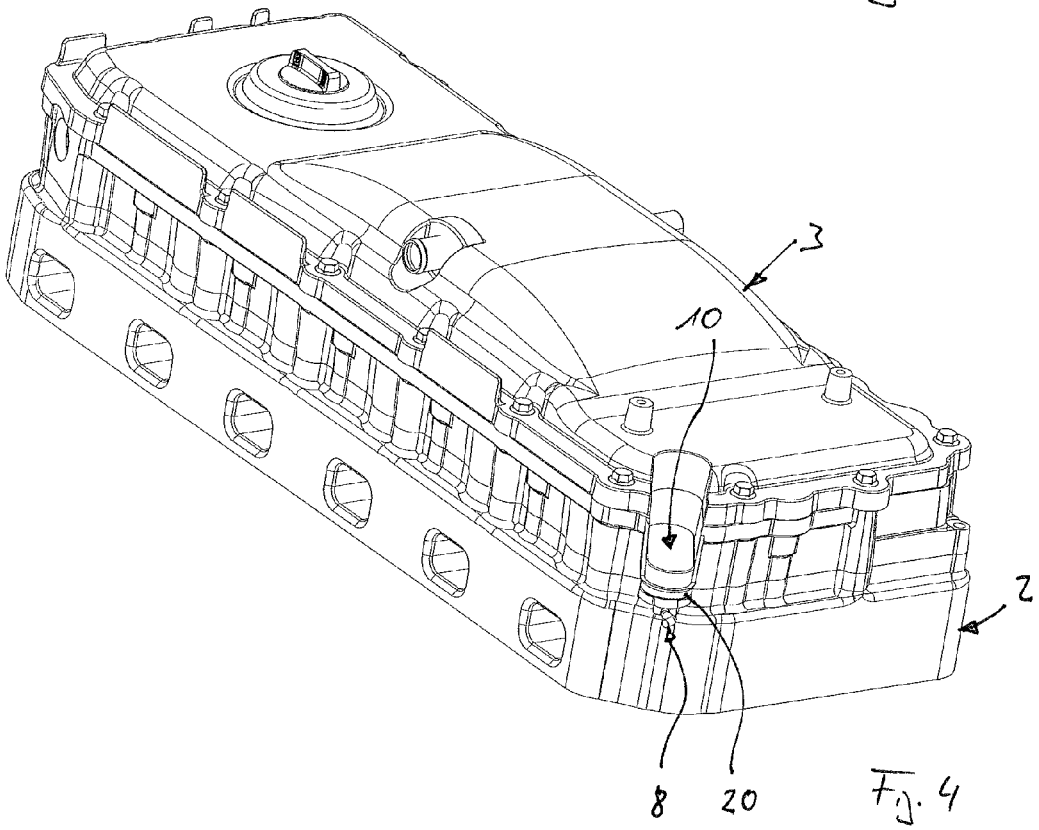

In the embodiment shown in FIGS. 2 to 4, the connecting bridge 10 is a separate component with respect to the cylinder head cover 3. Thus, the possibility also exists of mounting the connecting bridge 10 according to FIG. 3, in order to connect the internal wiring 6 to the external wiring 8, even if the cylinder head cover 3 is absent. This can be advantageous for particular inspections of the internal combustion engine 1.

As illustrated in the figures, the cylinder head cover 3 can have further functional units, such as e.g. an oil-filler neck 29 with cover 30 or a crankcase ventilation system 31 or respectively its connections 32.

The invention claimed is:

1. An internal combustion engine of a motor vehicle comprising:

a cylinder head having an open cylinder head interior on a cylinder head side, a cylinder head cover disposed on the cylinder head for covering the cylinder head interior at the open cylinder head side, an internal wiring disposed in the cylinder head interior, for the electrical energy supply of electrical components of the internal combustion engine, wherein the internal wiring has at least one electrical internal interface being disposed on the cylinder head in the cylinder head interior, at least one connecting bridge having an inner connecting interface, an outer connecting interface and a plurality of electric lines electrically connecting the inner and outer connecting interfaces to each other;

wherein the inner connecting interface is associated with the electrical internal interface, and the outer connecting interface is associated with an electrical external interface of an external wiring disposed outside the cylinder head interior, such that the internal wiring is connected to the external wiring.

2. The internal combustion engine according to claim 1, wherein the electrical interfaces, the connecting interfaces and the connecting bridge are electrically connected with each other when the cylinder head cover is mounted on the cylinder head.

3. The internal combustion engine according to claim 1, further comprising a cover seal disposed between the cylinder head and cylinder head cover, the cover seal extending between the electrical interfaces so that the electrical internal interface is inside the cover seal and the electrical external interface is outside the cover seal.

4. The internal combustion engine according to claim 1, further comprising an inner interface seal surrounding the electrical internal interface and an outer interface seal surrounding the electrical external interface.

5. The internal combustion engine according to claim 4, wherein the interface seals are formed integrally on a cover seal.

6. The internal combustion engine according to claim 1, wherein the connecting bridge disposed on the cylinder head cover.

7. The internal combustion engine according to claim 1, wherein the connecting bridge is formed integrally on the cylinder head cover.

8. The internal combustion engine according to claim, claim 1, further comprising an electrical contacting embedded into a body of the connecting bridge configured to connect the connecting interfaces electrically with each other.

9. The internal combustion engine of claim 1, wherein the interfaces are separated from each other electrically when the cylinder head cover is removed from the cylinder head.

10. The internal combustion engine of claim 1, wherein the electrical internal interface, the electrical external interface, the inner connecting interface, the outer connecting interface and the connecting bridge are configured and arranged with each other so that the electrical internal and external interfaces are automatically electrically connected with each other upon mounting of the cylinder head cover on the cylinder head and are automatically separated from each other upon dismantling of the cylinder head cover from the cylinder head.

11. The internal combustion engine of claim 1, wherein the electrical internal interface and the inner connecting interface connect to each other through an inner through hole formed at the cylinder head cover, and the electrical external interface and the outer connecting interface connect to each other through an outer through hole formed at the cylinder head cover.

12. The internal combustion engine of claim 1, wherein the cylinder head cover has a web that extends between the electrical internal interface and the electrical external interface and receives a cover seal in a region of the connecting bridge.

13. A cylinder head cover for covering a cylinder head interior of a cylinder head comprising:

at least one connecting bridge having an inner connecting interface, an outer connecting interface and a plurality of electric lines electrically connecting the inner and outer connecting interfaces to each other;

wherein the inner connecting interface is automatically connected to an electrical internal interface of an internal wiring, and the outer connecting interface is automatically connected to an electrical external interface of an external wiring disposed outside the cylinder head interior, when the cylinder head cover is mounted on the cylinder head;

wherein the inner connecting interface is automatically electrically separated from the electrical internal interface, and the outer connecting interface is automatically electrically separated from the electrical external interface when the cylinder head cover is removed from the cylinder head.

14. The cylinder head cover according to claim 13, wherein the electrical interfaces and the connecting interfaces each form an electrical plug connection, wherein the two plug connections have plug-in directions which are generally parallel to each other.

15. The cylinder head cover according to claim 13, further comprising a cover seal disposed between the cylinder head and cylinder head cover, the cover seal extending between the interfaces so that the electrical internal interface is inside the cover seal and the electrical external interface is outside the cover seal.

16. The cylinder head cover according to claim 13, further comprising an inner interface seal surrounding the electrical internal interface and an outer interface seal surrounding the electrical external interface.

17. The cylinder head cover according to claim 16, wherein the interface seals are formed integrally on a cover seal.

18. The cylinder head cover according to claim 13, wherein the connecting bridge is disposed on the cylinder head cover.

19. The cylinder head cover according to claim 13, wherein the connecting bridge is formed integrally on the cylinder head cover.

20. The cylinder head cover according to claim 13, further comprising an electrical contacting embedded into a body of the connecting bridge configured to connect the connecting interfaces electrically with each other.

* * * * *